US011248599B2

(12) United States Patent
Vasquez

(10) Patent No.: US 11,248,599 B2
(45) Date of Patent: Feb. 15, 2022

(54) SYSTEM FOR MONITORING CONCRETE PUMPING SYSTEMS

(71) Applicant: Julio Vasquez, Houston, TX (US)

(72) Inventor: Julio Vasquez, Houston, TX (US)

( * ) Notice: Subject to any disclaimer, the term of this patent is extended or adjusted under 35 U.S.C. 154(b) by 0 days.

(21) Appl. No.: 17/275,572

(22) PCT Filed: Sep. 23, 2019

(86) PCT No.: PCT/US2019/052428

§ 371 (c)(1),
(2) Date: Mar. 11, 2021

(87) PCT Pub. No.: WO2020/068667

PCT Pub. Date: Apr. 2, 2020

(65) Prior Publication Data

US 2021/0310482 A1 Oct. 7, 2021

Related U.S. Application Data

(60) Provisional application No. 62/738,603, filed on Sep. 28, 2018.

(51) Int. Cl.

| | |
|---|---|
| ***F04B 51/00*** | (2006.01) |
| ***F04B 15/02*** | (2006.01) |
| ***F04B 7/00*** | (2006.01) |

(52) U.S. Cl.

CPC ..... *F04B 51/00* (2013.01); *F04B 7/003* (2013.01); *F04B 15/02* (2013.01); *F04B 15/023* (2013.01); *F04B 2201/0201* (2013.01); *F04B 2207/70* (2013.01); *Y10S 417/90* (2013.01)

(58) Field of Classification Search

CPC ..... F04B 51/00; F04B 15/02; F04B 15/023; F04B 2201/0201; F04B 2207/70; F04B 7/003; Y10S 417/90

See application file for complete search history.

(56) References Cited

U.S. PATENT DOCUMENTS

| | | | |
|---|---|---|---|
| 4,533,300 | A | 8/1985 | Westerlund et al. |
| 5,127,806 | A | 7/1992 | Benckert |
| 5,330,327 | A | 7/1994 | Anderson |
| 5,332,366 | A | 7/1994 | Anderson |
| 6,375,432 | B1 | 4/2002 | Krasney et al. |
| 6,882,960 | B2 | 4/2005 | Miller |

(Continued)

FOREIGN PATENT DOCUMENTS

| | | |
|---|---|---|
| CN | 202882433 | 4/2013 |
| CN | 102338134 | 8/2013 |

OTHER PUBLICATIONS

Putzmeister America, Inc. Ergonic URL: http://es.putzmeisteramerica.com/data/product_category/Ergonlc_CB-4028_US1.pdf.

*Primary Examiner* — Christopher S Bobish
(74) *Attorney, Agent, or Firm* — Bushman Werner, P.C.

(57) ABSTRACT

A system for monitoring a dual cylinder concrete pumping apparatus and a transition valve operated by an actuator. The system including position sensors to detect the position of pistons in the dual cylinders and the actuator. Additional sensors can monitor various aspects of the concrete pumping apparatus. A processor receives information from the sensors and transmits data to a monitor. When sensor data is outside of predetermined parameters, the processor sends an alert notice and a performance snapshot of the system to the monitor.

21 Claims, 2 Drawing Sheets

(56) References Cited

U.S. PATENT DOCUMENTS

| | | | | |
|---|---|---|---|---|
| 6,986,303 | B2 | 1/2006 | Remus | |
| 7,581,935 | B2 * | 9/2009 | Hofmann | F04B 7/0241 417/28 |
| 7,611,331 | B2 * | 11/2009 | Hoefling | F04B 7/0241 417/12 |
| 8,403,649 | B2 * | 3/2013 | Sanger | F04B 9/117 417/46 |
| 8,437,922 | B2 | 5/2013 | Douglas | |
| 8,696,323 | B2 | 4/2014 | Amann et al. | |
| 8,874,383 | B2 | 10/2014 | Gambler et al. | |
| 9,651,033 | B2 * | 5/2017 | Pirri | F04B 1/02 |
| 2009/0220358 | A1 | 9/2009 | Krivsky et al. | |
| 2011/0231114 | A1 | 9/2011 | Roys | |
| 2015/0211503 | A1 * | 7/2015 | Hofmann | F04B 49/002 417/275 |
| 2016/0040659 | A1 * | 2/2016 | Schwing | F04B 7/0026 417/510 |
| 2016/0195093 | A1 | 7/2016 | Carpenter et al. | |

* cited by examiner

SYSTEM FOR MONITORING CONCRETE PUMPING SYSTEMS

CROSS REFERENCE TO RELATED APPLICATION

This application is a national phase of PCT/US2019/052428, filed Sep. 23, 2019, which in turn claims priority to U.S. 62/738,603, filed Sep. 28, 2018, the disclosures of which are incorporated herein by reference for all purposes.

FIELD OF THE INVENTION

The present invention relates to a monitoring system for concrete pumps. In particular, the present invention relates to a monitoring system for multi-cylinder hydraulic concrete pumps.

BACKGROUND OF THE INVENTION

Multi-cylinder piston pumps have been the standard choice for pumping large amounts of liquid concrete for decades. A typical multi-cylinder pump uses two cylinders which each alternately pull concrete out of a filling chamber through a respective inlet opening and then force the concrete through a single outlet opening. One piston draws liquid concrete into a cylinder from the filling chamber or hopper while the other piston simultaneously pushes its concrete out into the discharge pipes. While one is filling, the other is emptying, and vice versa. A valve determines which cylinder is open to the concrete hopper and which one is open to the discharge pipe. The valve has a valve element which switches positions each time the pistons reach their preset end points and the process continues with the first cylinder now discharging and the second drawing fresh concrete from the hopper. Generally, the valve element changes positions by rocking or transitioning back and forth between positions in response to the action of an actuator, and accordingly it is generally referred to as a transition valve. Such transition valves can comprise rock valves, S-tubes, etc. An example of a typical transition valve can be found in U.S. Pat. No. 4,057,373, incorporated herein by reference for all purposes.

The twin cylinders of the typical concrete pump described above work simultaneously with the pistons moving in a synchronous pattern. If there is a problem in the system, it can cause the pistons to become out of sync with each other. This ultimately will cause a pump failure which can be costly and time-consuming to correct. The present invention provides a system which will monitor the concrete pump system and alert the user to an issue before a critical failure of the system.

SUMMARY OF THE INVENTION

In one aspect, the present invention relates to a system for monitoring a concrete pumping apparatus.

In another aspect, the present invention relates to a system of position sensors for monitoring a dual cylinder concrete pumping apparatus.

In yet another aspect, the present invention relates to a system for monitoring various components of a dual cylinder concrete pump and notifying an operator when a component is operating outside programmed parameters.

In still another aspect, the present invention relates to a system which can be retrofit on existing concrete pump systems to monitor the components and notify an operator when a component is operating outside parameters.

These and further features and advantages of the present invention will become apparent from the following detailed description, wherein reference is made to the figures in the accompanying drawings.

DETAILED DESCRIPTION OF PREFERRED EMBODIMENTS

Figure 1:
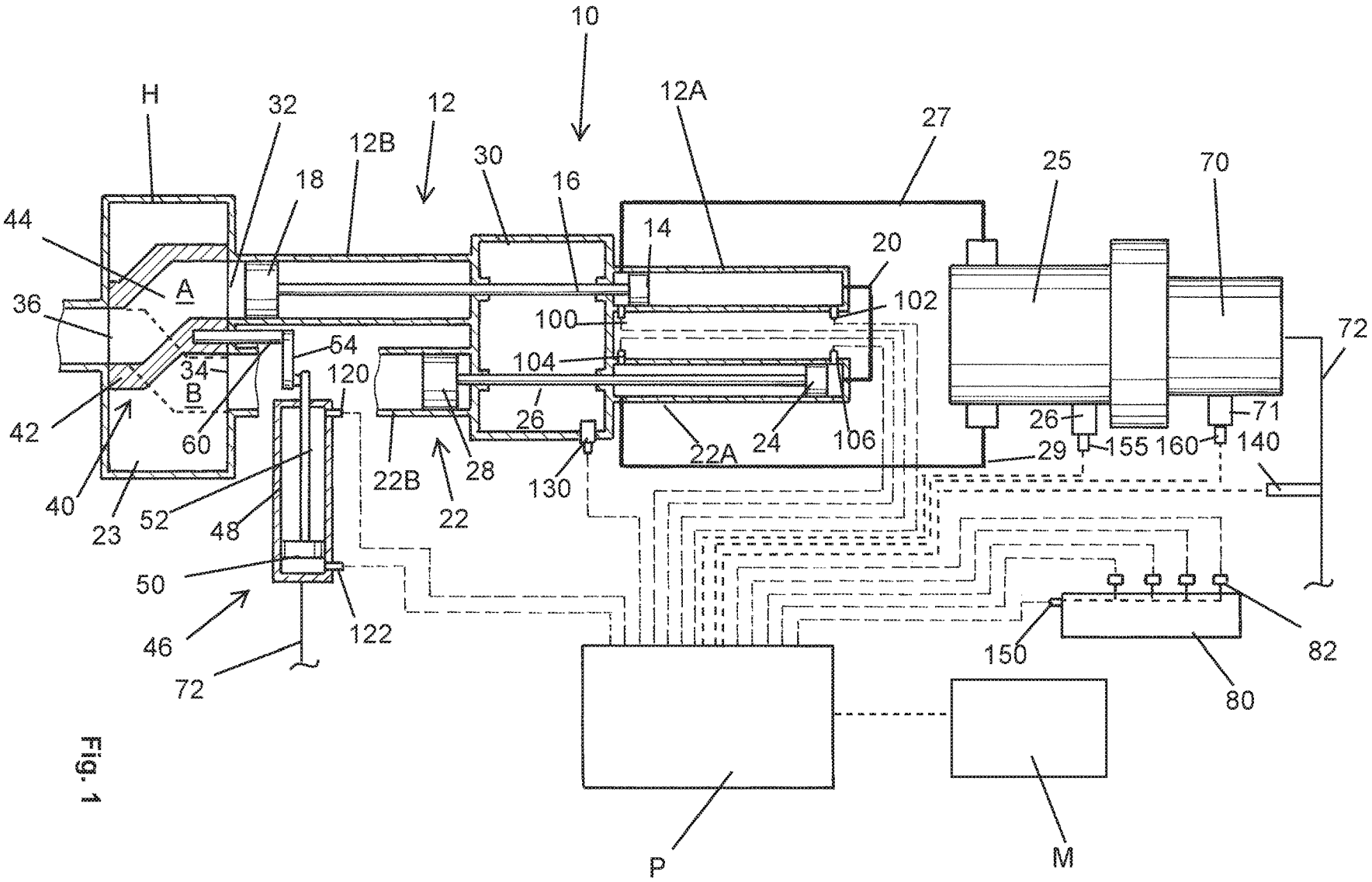
FIG. 1 is a schematic view of the system of one embodiment of the present invention.

Turning first to FIG. 1, the monitoring system of the present invention is shown with respect to a typical dual cylinder concrete pump. It will be appreciated that certain features of the concrete pump, e.g., hydraulic lines, electrical lines, mechanical connections, seals, bearings, etc., are not depicted, but would be well known to those skilled in the art.

The concrete pump shown generally as 10 includes first and second cylinders 12 and 22, respectively. In a preferred embodiment, cylinders 12 and 22 are each divided into two chambers 12A and 12B, and 22A and 22B, respectively. Referring first to cylinder 12, disposed in chamber 12A is piston 14. Piston 14 is connected to one end of piston rod 16 which extends into chamber 12B and connects to ram 18 at its other end. Similarly, in chamber 22A, piston 24 is connected to one end of piston rod 16 which then connects to ram 28 in chamber 22B. Pump 25 pumps hydraulic fluid into chambers 12A and 22A via lines 27 and 29, respectively. Chambers 12A and 22A are further connected to one another by hydraulic line 20. Hydraulic fluid can thus move between chambers 12A and 22A to alternatively drive pistons 14 and 24, respectively. It will be understood that the exact configuration of pumps and hydraulic lines can vary in ways well known to those skilled in the art. For example, while pump 25 pumps fluid to both chambers 12A and 22A, the chambers could each have a separate pump.

In a preferred embodiment, a water box 30 is disposed between chambers 12A and 12B, and between 22A and 22B. Water box 30 is in open communication with chambers 12B and 22B. Water from water box 30 thus flows into chambers 12B and 22B and serves to lubricate and cool rams 18 and 28.

A hopper H is positioned at the end of cylinders 12 and 22. Hopper H forms a chamber 23 into which concrete is deposited. There are first and second inlets 32 and 34 into chamber 23 through which concrete is pulled into cylinders 12 and 22, respectively, and a single outlet 36 through which concrete is dispersed. Outlet 36 can connect to another means of transferring concrete, such as a boom pump. A transition valve shown generally as 40 alternatively connects the first and second inlets 32 and 34 to the outlet 36. Transition valve 40 includes valve element 42 with a passageway 44 extending therethrough. The valve element is depicted with passageway 44 extending from inlet 32 to outlet 36. The other position of valve element 42, connecting inlet 34 to outlet 36, is shown in phantom. Actuator 46 is operatively connected to valve element 42 and operates to move valve element 42 back and forth through its two positions. As depicted, actuator 46 comprises a piston cylinder 48 housing a piston 50 and piston rod 52. Piston rod 52 is eccentrically connected to link 54 which in turn connects to a shaft 60 which is fixedly connected to valve element 42. Fluid from accumulator pump 70 travels through hydraulic line 72 to move piston 50 in cylinder 48. While the details are not depicted, it will be understood to those of skill in the art that the linear movement of piston 50 in cylinder 48 is translated by link 54 into rotational movement of shaft 60 and thus valve element 42. It will be understood that the specific features and connections between actuator 46 and valve element 42 can vary in ways well known to those skilled in the art.

A solenoid manifold or bank 80 with multiple solenoid valves 82 is connected to various components of the system in a manner well known to those skilled in the art. The solenoid manifold 80 controls the flow of hydraulic fluid to various components in system 10 in a manner well known to those skilled in the art. Again, the specific piping, seals, and the like are well known components and are not depicted in the FIG. 1. Additionally, while depicted with four solenoid valves 82, it will be well understood that the solenoid manifold 80 can include more valves 82 or fewer valves 82, as need in the particular pump system. In a preferred embodiment, the solenoid manifold 80 is a remote-controlled whip hose solenoid valve manifold.

In operation, liquid concrete is poured into hopper H from a concrete truck or other carrier known to those skilled in the art. The concrete is pulled from hopper H through one of inlets 32 and 34. As depicted in FIG. 1, valve element 42 is in position A such that concrete has been pulled from hopper H, through inlet 34 into chamber 22B. Actuator 46 then moves valve element 42 to position B, shown in phantom. In position B, passageway 44 connects inlet 34 and outlet 36. Piston cylinder assemblies 12 and 22 then switch positions. Ram 28 pushes the concrete in chamber 22B through passageway 44 and out through outlet 36 into a dispersing system well known to those skilled in the art, e.g., a concrete boom. While ram 28 is pushing the concrete out through passageway 44, more concrete is pulled from hopper H into chamber 12B. When rams 18 and 28 have reached the end of their respective strokes, actuator 46 then operates to return valve element 42 to its first position shown in FIG. 1. Ram 18 then pushes the concrete through inlet 32, through passageway 44, and out through outlet 36. While ram 18 pushes concrete out, liquid concrete from the hopper H is pulled into chamber 22B again. The cycle then repeats. It will be appreciated that the above description is one general example of a typical dual cylinder concrete pumping system.

It will be apparent from the above description that to operate properly, pistons 14 and 24, and thus rams 18 and 28, must remain diametrically opposite one another. When piston 14 and ram 18 are positioned all the way to the right, piston 24 and ram 28 must be positioned all the way to the left. The synchronous movement of the piston assemblies 12 and 22 allows for near constant pumping of concrete from the hopper H out through outlet 36. If there is a problem in the system, it can cause the pistons 14 and 24 to become out of sync with each other. This ultimately will cause a pump failure which can be dangerous, costly, and time-consuming to correct.

The present invention provides a system for monitoring the performance of a concrete pump system and detecting problems before they cause system failures. Position sensors 100, 102, 104, and 106 are operatively connected to chambers 12A and 22A and connected to processor P. The sensors are located at the outer ends of travel of pistons 14 and 24. Sensors 100 and 106 are diametrically opposite one another. Likewise, sensors 102 and 104 are diametrically opposite one another. The position sensors detect the position of pistons 14 and 24. When a piston reaches a sensor, the respective sensor sends off a signal to processor P. When the pump is working properly, pistons 14 and 24 are in sync and thus sensors 100 and 106 send signals at the same time, and sensors 102 and 104 send signals at the same time.

Processor P is connected to monitor M. Monitor M is any interface, screen, or display, in which the end user may view the data from processor P. Monitor M may be an onsite monitoring system, and/or one or more remote mobile devices such as a phone or tablet. Processor P may communicate with monitor M in a variety of ways well known to those skilled in the art, including through hardwire, cellular signal, Wi-Fi, Bluetooth™, etc.

As stated above, each position sensor in a pair, 100/106 and 102/104 should send signals essentially at the same time. If one of the sensors in a pair, 100/106 or 102/104 sends a signal at a different time from the other sensor in the pair, then the pistons are out of sync. This indicates a problem in the system. Processor P is programmed to detect if the signals from sensor pairs 100/106 and 102/104 are outside a predetermined time window. Positions sensors 100 and 106 must issue signals within 10 seconds of each other, preferably within 5 seconds of each other, more preferably within 1 second of each other, even more preferably within 0.75 seconds of each other, and most preferably within 0.5 seconds of each other. Positions sensors 102 and 104 must issue signals within 10 seconds of each other, preferably within 5 seconds of each other, more preferably within 1 second of each other, even more preferably within 0.75 seconds of each other, and most preferably within 0.5 seconds of each other.

If the signals are outside the acceptable time window, processor P sends an alert or notice to monitor M which is manned by an operator/end user. The alert may include a simple error message or alarm. The operator can then investigate the system and determine what steps should be taken to fix the situation. The system of the present invention can be configured to issue a visual alarm such as through flashing lights, to issue an audible alarm, or even to alert through mobile devices. In a preferred embodiment, the processor P does not control any features of the concrete pump, however, if desired the processor P may be programmed to shut down the concrete pump if processor P detects signals outside the acceptable parameters.

The system of the present invention can be used to monitor various parts of the system in addition to pistons 14 and 24. In a preferred embodiment, position sensors 120 and 122 are operatively connected to actuator 46 to sense the position of piston 50. If something causes piston 50 to slow or stop, valve element 42 will no longer be in register with the inlets 32/34 when rams 18/28 push the concrete through. When pistons 14 and 24 are in between their respective ends of travel, piston 50 should remain at one of its ends of travel. In other words, while pistons 14 and 24 are moving, piston 50 is still, and vice versa. Thus, at least one of the three pistons, 14, 24 and 50 will be detected by a position sensor at any given moment.

The position sensors of the present invention can be of various types. For example, sensors 100, 102, 104, 106, 120, and 122, can comprise a proximity sensor. Non-limiting examples of proximity sensors include capacitive, inductive, magnetic, etc. It will also be recognized that the position sensors can comprise a device such as a limit switch, a reed switch, etc. In general, any device which can detect the presence of the piston when the piston is in register with the device can be used.

In a preferred embodiment, additional sensors, discussed more fully hereafter, monitor performance and communicate with processor P. Water level sensor 130 is operatively connected to water box 30 and detects if the water level in water box 30 gets too low. The water level must be above the level of the piston rods. The water level sensor in water 30 can be of various types, including but not limited to a float switch, a laser sensor, or any other type which will send a signal when the water reaches a certain level.

Pressure sensor 140 is operatively connected to line 72 and detects detect the pressure in line 72. The pressure in line 72 must be between 150 and 200 bar. Pressure sensor 140 can be pressure transducers, pressure transmitters, pressure senders, pressure indicators, piezometers, manometers, etc.

Flow meters 155 and 160 are operatively connected to pumps 25 and 70. Preferably flow meters 155 and 160 are connected to case drains 26 and 71 of pumps 25 and 70, respectively, and monitor the flow of fluid through the case drains. As will be understood by those of skill in the art, there should be no fluid flow through the case drains. Such flow can indicate a weakening of internal integral components which may cause a failure in the pump. The pumps of the type in system 10 have a maximum flow rate. Generally fluid flow through a casing drain should not exceed 2% of the maximum flow rate of the particular pump. The flow meters 155 and 160 will signal processor P of any flow through casing drains. If the flow exceeds 0.25% of maximum flow rate, processor P will generate the alert and report as described above. In a preferred embodiment, the same will occur if flow exceeds 0.5%, 0.75% and 1.0% of maximum flow rate. This allows the user to track the degradation of the system and better determine when repairs should be undertaken. The flow meters 155 and 160 can be turbine flow sensors, ultrasonic flow sensors, vortex flow sensors, positive displacement flow sensors, venturi meters, electromagnetic flow sensors, rotameters, etc. In a preferred embodiment, the flow meters 155 and 160 are turbine flow sensors.

All the aforementioned sensors send signals to processor P throughout the operation of system 10. Processor P is programmed to collect the signals and compare the measurements to the specified parameters set forth above for each sensor. If processor P receives a signal outside any of these operational parameters, an alert is generated. In a preferred embodiment, processor P, in addition to generating an alert sends a full status report and snapshot of the system to monitor M. Thus, if for example, piston 24 slows down, the operator receives a snapshot of the system and sees that piston 24 has slowed down, but also sees whether the water level in water box 30 is sufficient, whether piston 50 in actuator 46 is positioned properly, whether there is sufficient pressure in the hydraulic line 72, and whether fluid is flowing through the pump case drains 26 and 71. The snapshot of the system can be in the form of a list or table of parameters, an image or schematic of the system, an interactive rendering of the system, or any other form in which the comprehensive information regarding the system can be made readily available to the operator. This comprehensives snapshot of the pump system allows an operator to locate the source of a problem in the system immediately, and also prevents future problems. Additionally, processor P stores the data and can provide reports yearly, monthly, weekly, etc. as desired by the end user.

In addition, to the above sensors which trigger an alert and snapshot report by processor P there is a pressure sensor 150 connected to solenoid valve manifold 80. Every time one of the solenoid valves 82 opens, the pressure in the line is measured by pressure sensor 150. The signals from pressure sensor 150 are sent to processor P. While the signals from pressure sensor 150 do not trigger an alert or snapshot report, the signal information is included in any snapshot report triggered when any of the other sensors detects a signal outside the specified parameters. Pressure sensor 150 can be a pressure transducer, pressure transmitter, pressure sender, pressure indicator, piezometer, manometer, etc.

Figure 2:
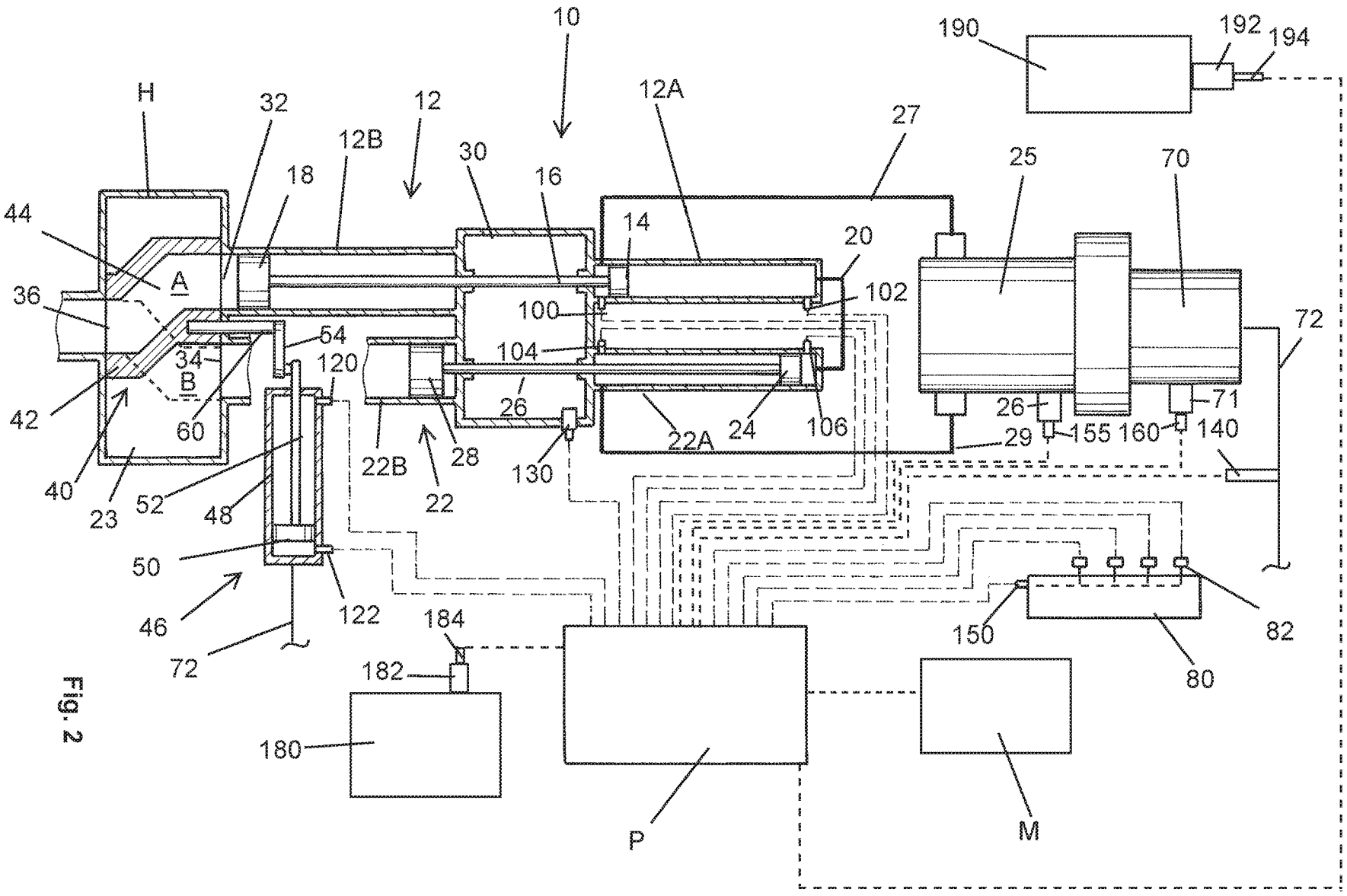
FIG. 2 is a schematic view of the system of another embodiment of the present invention.

Turning to FIG. 2 it will be understood that parts which are the same as in FIG. 1 have the same reference numbers as those in FIG. 1. FIG. 2 depicts a system with additional components. As noted above, outlet 36 can be connected to a concrete boom. In such a situation, the operator of the concrete pumping system may wish to monitor the boom pump using the system of the present invention. Accordingly, FIG. 2 depicts boom pump 180 which would pump the concrete through a boom (not shown) to a slab, foundation, or other site requiring the concrete. Boom pump 180 has case drain 182 and flow meter 184. As with case drains 26 and 71, and flow meters 155 and 160, respectively, flow meter 184 measures for through case drain 182 and sends the flow information to processor P. If the flow exceeds 0.25% of maximum flow rate for pump 180, processor P will generate the alert and report as described above with respect to FIG. 1, and include the boom pump 180 information in the snapshot report. In a preferred embodiment, the same will occur if flow exceeds 0.5%, 0.75% and 1.0% of maximum flow rate. This allows the user to track the degradation of the system and better determine when repairs should be undertaken. The flow meter 184 can be turbine flow sensors, ultrasonic flow sensors, vortex flow sensors, positive displacement flow sensors, venturi meters, electromagnetic flow sensors, rotameters, etc. In a preferred embodiment, the flow meter 180 is a turbine flow sensor.

Also depicted in FIG. 2 is accumulator pump 190 which improves the efficiency of pumps 25 and 70. Accumulator pump 190 has case drain 192, and flow meter 194. Flow meter 194 measure flow through case drain 192 and sends the flow information to processor P. If the flow exceeds 0.25% of maximum flow rate for accumulator pump 190, processor P will generate the alert and report as described above with respect to FIG. 1, and include the accumulator pump 190 information in the snapshot report. In a preferred embodiment, the same will occur if flow exceeds 0.5%, 0.75% and 1.0% of maximum flow rate. This allows the user to track the degradation of the system and better determine when repairs should be undertaken. The flow meter 194 can be turbine flow sensors, ultrasonic flow sensors, vortex flow sensors, positive displacement flow sensors, venturi meters, electromagnetic flow sensors, rotameters, etc. In a preferred embodiment, the flow meter 194 is a turbine flow sensor.

In all other respects, the system of FIG. 2 is the same as that of FIG. 1 and the details will not be repeated.

The system of the present invention provides several advantages to the concrete pumping industry. The system can be retrofitted onto existing pump systems. The comprehensive monitoring and alert system prevents malfunctions and thereby reduces machine downtime, reduces costs, improves safety, and extends the overall operating life of the pump system.

Although specific embodiments of the invention have been described herein in some detail, this has been done solely for the purposes of explaining the various aspects of the invention and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. In a pumping system for slurries, the system having a filling chamber for said slurry, the chamber having first and second inlets and an outlet, a first piston cylinder assembly being connected to said first inlet and having a first piston, a first cylinder, and a first piston terminal position, a second piston cylinder assembly connected to said second inlet and having a second piston, a second cylinder, and a second piston terminal position, a valve having a valve element mounted in said chamber, said valve element having a passageway therethrough, said valve element being movable between a first position wherein said passageway is in register with said first inlet and said outlet, and a second position wherein said passageway is in register with said second inlet and said outlet, an actuator operatively connected to said valve to move said valve element between said first and second positions, wherein when said first piston cylinder assembly is drawing said slurry into said first cylinder, said valve element is in said second position, and when said first piston cylinder assembly is pumping slurry through said valve element, said valve element is in said first position, an improvement comprising a monitoring system operatively connected to said pumping system, said monitoring system comprising:

a first position sensor for determining when said first piston is in said first piston terminal position and generating a first signal;

a second position sensor for determining when said second piston is in said second piston terminal position and generating a second signal;

a third position sensor for determining when said actuator has moved said valve element to said first position and generating a third signal; and a fourth position sensor for determining when said actuator has moved said valve element to said second position and generating a fourth signal;

a processor for receiving said first, second, third, and fourth signals, said processor determining if said signals are generated within a predetermined time window of one another and, if any of said signals are outside said predetermined time window, said processor generating an alert and a report;

a monitor operative to receive said report and display it to an end user.

2. The system of claim 1 further comprising:

a water level sensor operatively connected to a water box in said pumping system for detecting when water in said water box drops to a certain level and generating a water level signal.

3. The system of claim 2, wherein said processor is programmed to receive said signals and determine if any of said signals is outside a predetermined set of operational parameters and, if any of said signals are outside said predetermined operational parameters, said processor generates a report.

4. The system of claim 1, further comprising:

a flow meter operatively connected to a case drain of a pump in said pumping system for detecting the amount of flow through said case drain and generating a flow signal.

5. The system of claim 4, wherein said processor is programmed to receive said signals and determine if any of said signals is outside a predetermined set of operational parameters and, if any of said signals are outside said predetermined operational parameters, said processor generates a report.

6. The system of claim 1, further comprising:

a pressure sensor operatively connected to a hydraulic line in said pumping system for detecting fluid pressure in said hydraulic line and generating a hydraulic line pressure signal.

7. The system of claim 6, wherein said processor is programmed to receive said signals and determine if any of said signals is outside a predetermined set of operational parameters and, if any of said signals are outside said predetermined operational parameters, said processor generates a report.

8. The system of claim 1, further comprising:

a pressure sensor operatively connected to a solenoid manifold in said pumping system for detecting fluid pressure in said solenoid manifold and generating a solenoid manifold pressure signal.

9. The system of claim 8, wherein said processor is programmed to receive said signals and determine if any of said signals is outside a predetermined set of operational parameters and, if any of said signals are outside said predetermined operational parameters, said processor generates a report.

10. The system of claim 9, wherein said report is displayed on said monitor and includes all of said signals received from all of said sensors.

11. The system of claim 1, wherein said alert is selected from the group consisting of visual alerts, audible alerts, and both.

12. The system of claim 1, wherein said report is in the form of a list, a table, an image, an interactive rendering, or a combination thereof.

13. The system of claim 1, wherein said monitor is selected from the group consisting of a computer screen, a mobile phone, a tablet, and combinations thereof.

14. The system of claim 1, further comprising:

a flow meter operatively connected to a case drain of a boom pump in said pumping system for detecting the amount of flow through said boom pump case drain and generating a flow signal.

15. The system of claim 1, further comprising:

a flow meter operatively connected to a case drain of an accumulator pump in said pumping system for detecting the amount of flow through said accumulator pump case drain and generating a flow signal.

16. The system of claim 15, wherein said processor is programmed to receive said signals and determine if any of said signals is outside a predetermined set of operational parameters and, if any of said signals are outside said predetermined operational parameters, said processor generates a report.

17. The system of claim 14, wherein said processor is programmed to receive said signals and determine if any of said signals is outside a predetermined set of operational parameters and, if any of said signals are outside said predetermined operational parameters, said processor generates a report.

18. The system of claim 17, wherein said report is displayed on said monitor and includes all of said signals received from all of said sensors.

19. The system of claim 17, wherein said alert is selected from the group consisting of visual alerts, audible alerts, and both.

20. The system of claim 17, wherein said report is in the form of a list, a table, an image, an interactive rendering, or a combination thereof.

21. The system of claim 17, wherein said monitor is selected from the group consisting of a computer screen, a mobile phone, a tablet, and combinations thereof.

* * * * *